US005697242A

United States Patent [19]

Halasz et al.

[11] Patent Number: 5,697,242

[45] Date of Patent: *Dec. 16, 1997

[54] METHOD AND APPARATUS FOR REFORMING CAN BOTTOM TO PROVIDE IMPROVED STRENGTH

[75] Inventors: Andrew Halasz, Crystal Lake; Sylvan Praturlon, Oak Park; Paul Azzaline, Crystal Lake; Christopher Caliendo, Wood Dale, all of Ill.

[73] Assignee: American National Can Company, Chicago, Ill.

[ * ] Notice: The term of this patent shall not extend beyond the expiration date of Pat. No. 5,222,385.

[21] Appl. No.: 670,324

[22] Filed: Jun. 25, 1996

Related U.S. Application Data

[62] Division of Ser. No. 563,900, Nov. 22, 1995, abandoned, which is a continuation of Ser. No. 343,837, Nov. 23, 1994, abandoned, which is a continuation of Ser. No. 212,647, Mar. 3, 1994, abandoned, which is a continuation of Ser. No. 50,526, Apr. 20, 1993, abandoned, which is a continuation of Ser. No. 735,994, Jul. 25, 1991, Pat. No. 5,222,385, which is a continuation-in-part of Ser. No. 730,794, filed as PCT/US90/00451, Jan. 26, 1990, Pat. No. 5,349,837.

[51] Int. Cl.[6] ..... B21D 51/26

[52] U.S. Cl. ..... 72/117; 72/379.4

[58] Field of Search ..... 72/111, 110, 94, 72/117, 122, 123, 124, 125, 379.4; 413/69

[56] References Cited

U.S. PATENT DOCUMENTS

| | | |
|---|---|---|
| 994,468 | 6/1911 | Kane . |
| 1,031,264 | 7/1912 | Hinde et al. . |
| 1,441,674 | 1/1923 | Foster et al. . |
| 1,461,729 | 7/1923 | Foster et al. . |
| 2,158,312 | 5/1939 | Terrell . |
| 3,417,898 | 12/1968 | Bozek et al. . |
| 3,693,828 | 9/1972 | Kneusel et al. . |
| 3,904,069 | 9/1975 | Toukmanian . |
| 3,905,507 | 9/1975 | Lyu . |
| 3,942,673 | 3/1976 | Lyu et al. . |
| 4,108,324 | 8/1978 | Krishnakumar et al. . |
| 4,120,419 | 10/1978 | Saunders . |
| 4,134,354 | 1/1979 | Cvacho et al. . |
| 4,147,271 | 4/1979 | Yamaguchi . |
| 4,151,927 | 5/1979 | Cvacho et al. . |
| 4,199,073 | 4/1980 | Gombas . |
| 4,280,353 | 7/1981 | Murphy . |
| 4,289,014 | 9/1981 | Maeder et al. . |
| 4,294,097 | 10/1981 | Gombas . |
| 4,294,373 | 10/1981 | Miller et al. . |
| 4,341,321 | 7/1982 | Gombas . |
| 4,372,143 | 2/1983 | Elert et al. . |
| 4,381,061 | 4/1983 | Cerny et al. . |
| 4,402,419 | 9/1983 | MacPherson . |
| 4,412,627 | 11/1983 | Houghton et al. . |
| 4,419,319 | 12/1983 | Reynolds, Jr. et al. . |
| 4,454,742 | 6/1984 | Gombas . |
| 4,470,281 | 9/1984 | Kaporovich et al. . |
| 4,515,284 | 5/1985 | Lee, Jr. et al. . |

(List continued on next page.)

*Primary Examiner*—Lowell A. Larson
*Attorney, Agent, or Firm*—Wallenstein & Wagner, Ltd.

[57] ABSTRACT

A method and apparatus for reforming a bottom of a drawn and ironed beverage container is disclosed. The container has a longitudinal axis and a side wall parallel with the longitudinal axis. The bottom has an outer annular wall, a convex U-shaped portion and a preformed bottom wall. The preformed bottom wall includes a center domed portion. The bottom further has an annular, substantially longitudinal wall joining the domed portion and the convex U-shaped portion. The apparatus comprises a roller movable from an inward position where the roller does not contact the annular, substantially longitudinal wall to an outward position where the roller contacts the annular, substantially longitudinal wall, and a movable actuator to move the roller into engagement with and circumferentially about the annular, substantially longitudinal wall to reform the substantially longitudinal wall. The movable actuator moves the roller into engagement with the annular, substantially longitudinal wall to reform the substantially longitudinal wall to achieve a negative angle (A) relative to the longitudinal axis of the container.

22 Claims, 10 Drawing Sheets

U.S. PATENT DOCUMENTS 4,598,831 7/1986 Nakamura et al. .
4,620,434 11/1986 Pulciano et al. .
4,650,628 3/1987 Evely .
4,685,582 8/1987 Pulciani et al. .
4,717,523 1/1988 Evely .
4,722,215 2/1988 Taube et al. .
4,732,292 3/1988 Supik .
4,768,672 9/1988 Pulciani et al. .
4,834,256 5/1989 McMillin .
4,885,924 12/1989 Claydon et al. .
4,919,294 4/1990 Kawamoto et al. .
4,953,738 9/1990 Stirbis .
5,016,463 5/1991 Johansson et al. .
5,024,077 6/1991 Bulso, Jr. et al. .
5,069,052 12/1991 Porucznik et al. .
5,105,973 4/1992 Jentzsch et al. .
5,111,679 5/1992 Kobayashi et al. .
5,222,385 6/1993 Halasz et al. ..... 72/117
5,253,500 10/1993 Willoughby .
5,341,667 8/1994 Lee, Jr. .
5,372,028 12/1994 Brilman et al. .
5,433,098 7/1995 Bowlin et al. .
5,467,628 11/1995 Bowlin et al. .

METHOD AND APPARATUS FOR REFORMING CAN BOTTOM TO PROVIDE IMPROVED STRENGTH

RELATED APPLICATIONS

This is a divisional application of U.S. application Ser. No. 08/563,900, filed Nov. 22, 1995, now abandoned, which is a continuation of U.S. application Ser. No. 08/343,837, filed Nov. 23, 1994, now abandoned, which is a continuation of U.S. application Ser. No. 08/212,647, filed Mar. 3, 1994, now abandoned, which is a continuation of U.S. application Ser. No. 08/050,526, filed Apr. 20, 1993, now abandoned, which is a continuation of U.S. application Ser. No. 07/735, 994, filed Jul. 25, 1991 (now U.S. Pat. No. 5,222,385) which is a continuation-in-part of U.S. application Ser. No. 07/730, 794, filed Jul. 24, 1991 (now U.S. Patent No. 5,349,837), which is in turn based upon International Application No. PCT/US 90/00451, having an International filing date of Jan. 26, 1990.

TECHNICAL FIELD

The invention relates generally to a method and apparatus for reforming the bottoms of drawn and ironed beverage containers (or cans). The reformed can bottom is an integral part of beer and beverage cans, and increases the strength of those cans above that of prior art cans.

BACKGROUND OF THE INVENTION

Drawn and ironed cans are among the most widely used cans for carbonated beverages, including such beverages as beer and soft drinks. Such drawn and ironed cans are made from a disc of stock material which is converted into a shallow "cup" with short side walls. The base of this cup ultimately forms the bottom of the can, and the short side walls of the cup become the elongated side walls of the can.

The shallow cup is passed through a succession of ironing rings. As the spacing between successive rings becomes increasingly narrow, passage of the cup through these successive rings decreases the thickness and increases the height of the side walls.

The configuration of the bottom of such drawn and ironed cans has, over the last several years, been a topic of interest to both can manufacturers, packagers, shippers, retailers and the ultimate consumer who purchases products in such cans. This is because the configuration of the bottom is a factor in the ability of the can to resist its internal pressures and achieve adequate columnar strength. These internal pressures result from the weight, pressurization and carbonation of the liquids in the can. Columnar strength is the ability of a can to resist axial loads imposed by cans that are stacked upon other cans, as during transport and storage.

Can manufacturers are constantly striving to obtain high strength with relatively low weight. Generally, however, these goals are incompatible. Low weight, and a lowering of material cost, is generally achieved by reducing the thickness of the stock material. A reduction in stock material thickness, without more, lowers the strength of the can. Retailers and consumers desire a container which is stackable and which is of the lowest possible weight for ease in handling.

The bottom shape of the container has been found to be of importance in determining its strength. Issued U.S. patents disclosing this importance include U.S. Pat. No. 4,685, 582, issued to Pulciani et al. on Aug. 11, 1987, and entitled "Container Profile With Stacking Feature." This patent, which is assigned to the assignee of the present invention, discloses a so-called ANC-1A container having an inverted dome-shaped bottom. Other U.S. patents are also generally relevant. For example, U.S. Pat. Nos. 3,904,069, 3,979,009 and 4,412,627 disclose containers having bottom wall constructions designed to permit selected and controlled outward flexing or bulging of the bottom wall when the container is sealed and subjected to internal pressures developed by the contents.

Reforming of the bottom wall of a container of the general type described in this application has also been described in an International Publication to Metal Box plc. This publication is International Publication Number WO 83/02577, published on Aug. 4, 1983. This reforming takes place by applying a roller along the exterior transition wall 7 of the bottom of the container, rather than along its interior. See International Publication Number WO 83/02577, FIG. 7.

SUMMARY OF THE INVENTION

It is an object of the invention to provide an apparatus for reforming a bottom of a drawn and ironed beverage container. The container has a longitudinal axis and a side wall parallel with the longitudinal axis. The bottom has an outer annular wall, a convex U-shaped portion, a preformed bottom wall, including a center domed portion, and an annular, substantially longitudinal wall joining the domed portion and the convex U-shaped portion.

In accordance with the present invention, the apparatus comprises a roller movable from a radially inward position where the roller does not contact the annular, substantially longitudinal wall to a radially outward position where the roller contacts the annular, substantially longitudinal wall, and a movable actuator to move the roller into engagement with and circumferentially about the annular, substantially longitudinal wall to reform the substantially longitudinal wall.

It is comprehended that the movable actuator moves the roller into engagement with the annular, substantially longitudinal wall to reform the substantially longitudinal wall to achieve a negative angle (A) relative to the longitudinal axis of the container.

It is further comprehended that the apparatus includes a plurality of rollers. Each of the rollers is movable from a radially inward position where the rollers do not contact the annular, substantially longitudinal wall to a radially outward position where the rollers contact the annular, substantially longitudinal wall.

It is still further comprehended that the apparatus includes a radially inward support for the container. The radially inward support may comprises a jig supporting the container in opposition to the rollers along a lower end of the container. For example, the jig may have a bottom peripheral profile portion substantially corresponding in shape to the outer annular wall of the container, such that the bottom peripheral profile portion of the jig is mated with the outer annular wall of the container.

It is a further object of the invention to provide a method of reforming a bottom of a drawn and ironed container. The container has a longitudinal axis and a generally cylindrical side wall parallel with the longitudinal axis. The bottom has an outer annular wall, a convex U-shaped portion, a preformed bottom wall including a center domed portion, and an annular, substantially longitudinal wall joining the domed portion and the convex U-shaped portion.

In accordance with the invention, the method comprises providing the drawn and ironed container, providing a reforming roller, and moving the reforming roller radially into engagement with the substantially longitudinal wall. The reforming roller rotates along the longitudinal wall and circumferentially about an arcuate path, wherein the reforming roller affects the angle of the substantially longitudinal wall.

It is comprehended that the reforming roller affects the angle of the substantially longitudinal wall by achieving a negative angle (A) from the longitudinal axis of the container.

It is further comprehended that a radial inward support for the container is provided. The radial inward support may include supporting the container in a jig which supports the container along a lower end of the container. For example, the jig may include a bottom peripheral profile portion substantially corresponding in shape to the outer annular wall of the container, and the bottom peripheral profile portion of the jig mates with the outer annular wall.

Other features and advantages of the invention will be apparent from the following specification taken in conjunction with the following drawings.

DETAILED DESCRIPTION OF THE PREFERRED EMBODIMENT

This invention is susceptible of embodiment in many different forms. The drawings and this specification show a preferred embodiment of the invention. It will be understood, however, that this disclosure is to be considered an exemplification of the principles of the invention. The inventors do not intend to limit the broadest aspect of the invention to the illustrated embodiments.

Figure 8:
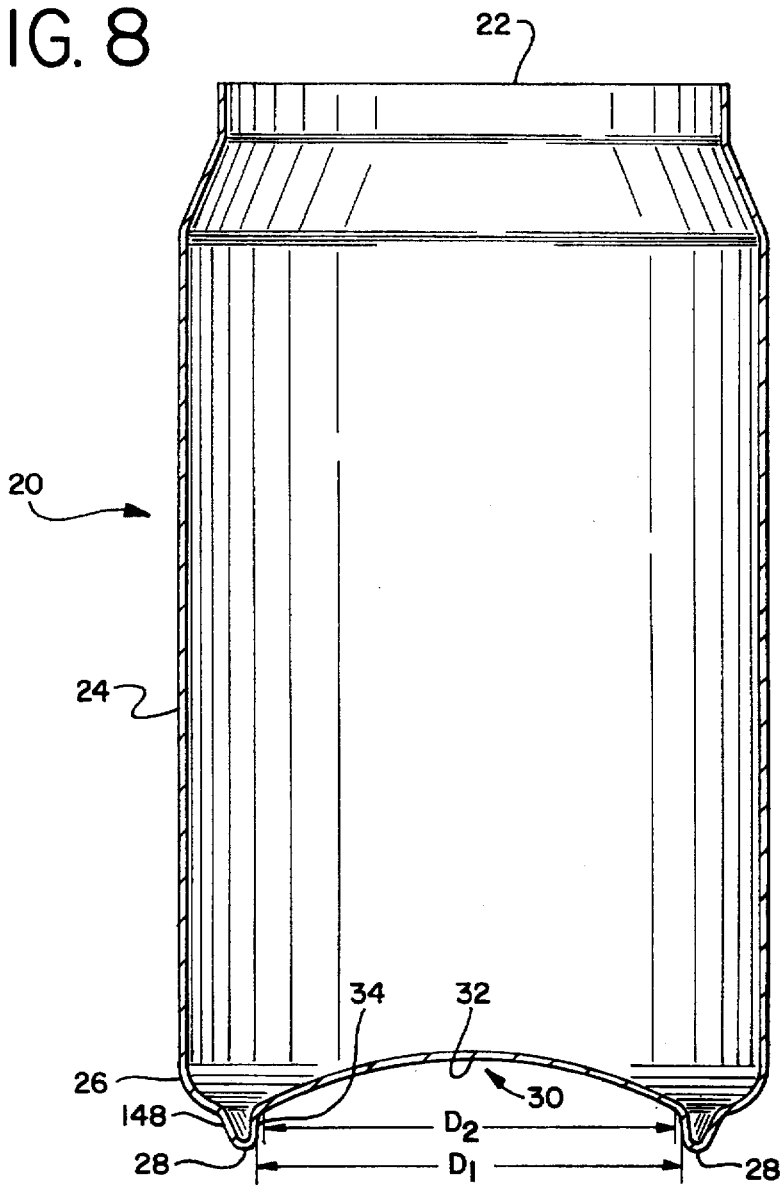
FIG. 8 is a side perspective view of a container which is suitable for treatment by the process and apparatus of the invention.

According to one aspect of the invention, the performance characteristics of a container formed by normal drawing and ironing procedures are improved by reforming the bottom end wall of the container from the initial configuration. This initial configuration is disclosed in the above-mentioned '582 patent and is shown in FIG. 8.

Figure 9:
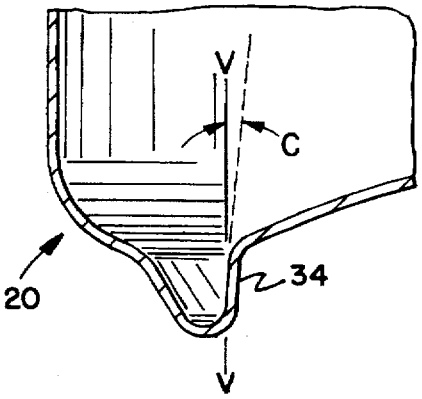
FIG. 9 is an enlarged view of the lower left hand corner of the container of FIG. 8, prior to reforming.
Figure 10:
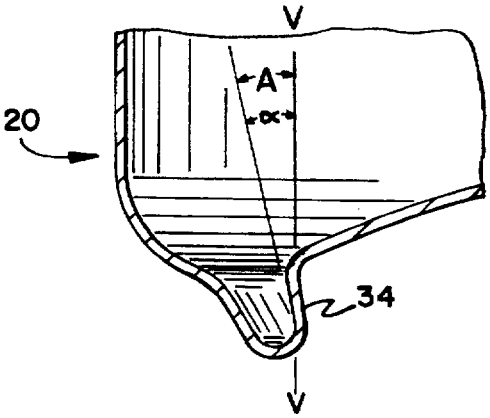
FIG. 10 is an enlarged view of the lower left hand corner of the container of FIG. 8, after reforming.

As described and shown in FIGS. 9 and 10 of copending International Application No. PCT/US 90/00451, after the fluted container has been necked, flanged, internally spray coated and externally printed, the bottom profile or countersink area of the bottom wall is reshaped. This is done by reforming the inner wall of the countersink to further improve buckle resistance and decrease can growth.

Figure 11:
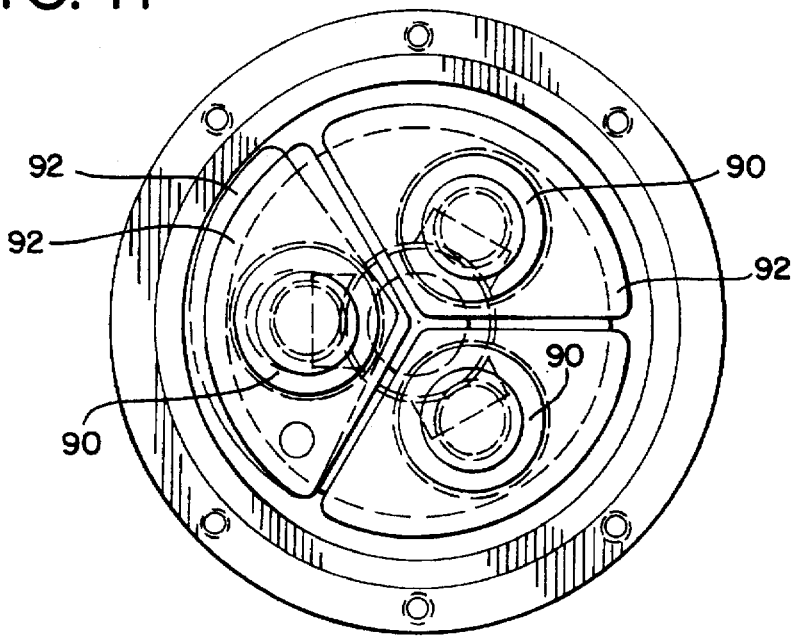
FIG. 11 is a top view of a non-pivoting embodiment of the apparatus in accordance with the invention.

In the prior co-pending application, the finished drawn and ironed container of FIG. 11 is supported in a suitable jig that has an internal opening which corresponds to the outer peripheral diameter of the container. The jig has a lower profile portion that conforms to the countersink wall portion the bottom wall of the container, as originally formed in accordance with the process disclosed in the '582 patent.

A plug is inserted into the upper end of the opening and securely held in the top of the container. During processing, this container is rotated about its axis. The bottom peripheral profile of the jig is in extended contact with the container bottom. A reforming roller is brought into engagement with the substantially vertical wall of the domed end of the container and is supported on a shaft. That shaft is designed to be rotated along an arcuate path around the center axis for the container. The roller has a peripheral configuration which defines a substantially vertical upwardly and outwardly tapered wall having a generally arcuate upper portion. The inner wall of the countersink is reformed to a more vertical profile while the dome is stretched to a small degree. The outer wall is held to its original configuration. Alternatively, the outer wall could also be reformed with the inner wall.

It was found in the co-pending application that this reforming operation significantly improves buckle resistance and decreases the amount of can growth, i.e., the amount that the bottom end wall is elongated when pressure is applied internally of the container.

The container produced according to the method and apparatus described in the co-pending application exhibited significantly greater column strength, i.e., resistance to crushing by vertical loads applied to the container side wall. That container also exhibited significantly less container growth during internal pressurization and improved buckle resistance. The container constructed in accordance with that invention was thus capable of being produced from stock flat disc material having a significantly reduced thickness.

The present invention is a further elaboration and refinement upon the invention described in the copending application. The invention is directed to the type of drawn or drawn and ironed container shown in FIG. 8. Such containers are well known in the art and are generally described and shown in U.S. Pat. No. 4,685,582, issued to the assignee of the present application on Aug. 11, 1987. This container 20 is symmetrical about a vertical axis 22. A generally cylindrical side wall 24 parallel with this vertical axis forms the panel on which graphics, such as a bottler's trademark, may be printed. An outer annular wall 26 forms a transitional portion between this side wall 24 and a convex, U-shaped portion 28 that defines a flange-like ridge. The outer annular wall 26 and U-shaped portion 28 enable these cans to be stacked. In particular, the bottom of a first can may be securely nested into the top of a second can.

The container 20 also includes a preformed bottom wall 30 including a center domed portion 32. An annular, substantially vertical wall 34 joins the domed portion 32 to the convex U-shaped portion 28. This "substantially vertical wall," for the purposes of this application, has an angle from the vertical of 0 to +5 degrees, and may be as high as +10 degrees. A positive angle is shown by angle C in FIG. 8.

Various kinds of apparatus may be used to effect the method of reforming container 20, as that method is described and claimed in the present application. As may be seen in FIGS. 1–3, one such apparatus includes a plurality of rollers 36. In a preferred embodiment, three rollers 36 may be used. The use of three rollers 36 has advantages over the use of fewer rollers, for example, a single roller. These rollers 36 are used to contact the annular, substantially vertical wall 34. The use of one roller would concentrate the forces transferred from the roller 36 to the wall 34 at one point. In contrast, three rollers 36 will spread the force on this wall 34 over three points.

Figure 2:
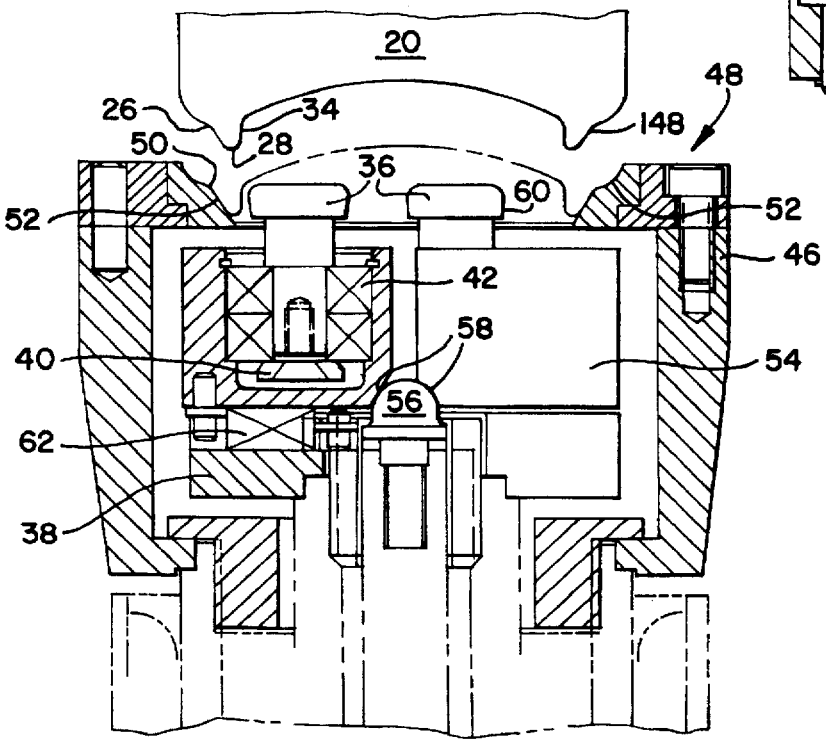
FIG. 2 is a side-sectional view of the apparatus of FIG. 1, and with a container shown in solid lines above the apparatus and in phantom lines in place for processing by the apparatus.

As may be seen in FIG. 2, each of these rollers 36 is indirectly secured to a pivot plate 38. Securing the rollers 36 are a bearing clamp 40 and a bearing 42.

Figure 1:
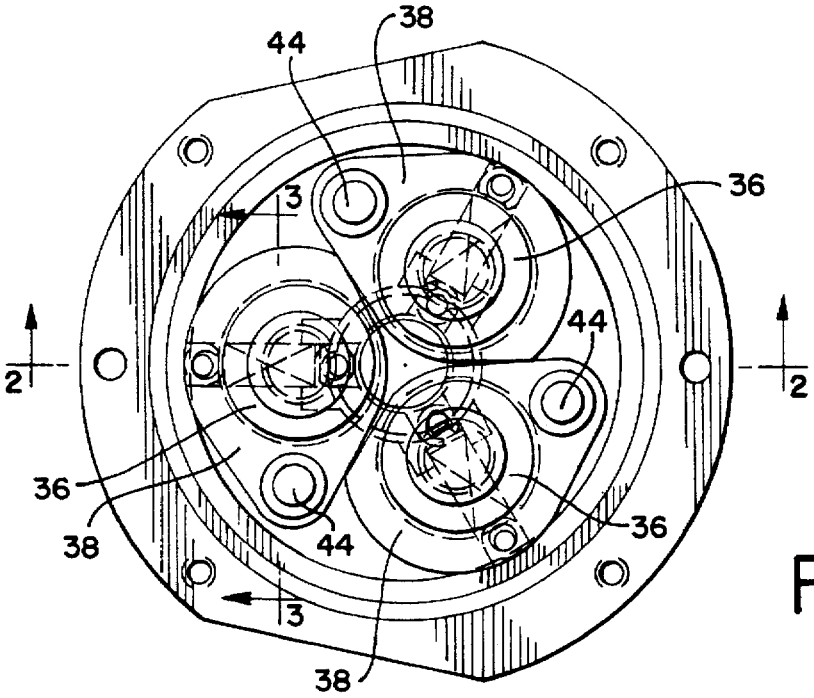
FIG. 1 is a top view of a pivoting apparatus in accordance with the invention, and in a radially inward, non-engaging position.

Each of the pivot plates 38 are designed to pivot around their respective pivot pin 44 (FIG. 1). In this embodiment, this pivot pin 44 is vertically disposed. As will be seen in other embodiments, however, other pivot pins may instead be horizontally disposed.

A tooling head collar 46 provides a support surface for a jig 48, or lower can support. This jig 48 is removable from the tooling head collar 46 and may be interchanged with another jig having a different shape to accommodate containers having various different lower end configurations.

Each jig 48 is manufactured so as to accommodate and support a given size container 20. Accordingly, a bottom peripheral profile portion 50 of the jig 48 substantially corresponds in shape to the outer annular wall 26 of the container 20. As will be explained below, this bottom peripheral profile portion 50 of the jig 48 is mated with the outer annular wall 26 of the container 20. In the embodiment shown in FIG. 2, it may be seen that the lowermost part 52 of this jig 48 also corresponds in shape to the radially outermost region of the convex U-shaped portion 28. In this way, the jig 48 provides greater support around the circumference of the container 20.

Supporting the bearings 42 and enclosing portions of the reforming rollers 36 are bearing housings 54. These bearing housings 54 are fixedly secured to their respective pivot plates 38. Thus, the motion of the pivot plates 38 and the bearing housings 54 is synchronous.

Movement of the pivot plates 38 and bearing housings 54 is facilitated by a vertically movable actuator ball 56. As shown in FIG. 2, this actuator ball 56 is positioned in a first, non-engaging position. In this position, the actuator ball 56 merely abuts against camming surfaces 58 on the bearing housing 54.

Upward, vertical movement urges the actuator ball 56 to a second position in which it contacts and pushes upwardly on camming surfaces 58. As a result of the shape of these camming surfaces 58, this upward movement causes the bearing housing 54 and pivot plate 38 to pivot together about the pivot pin 44 in a radially outward direction. This pivoting movement continues until rollers 36 contact the annular, substantially vertical wall 34.

The rollers 36, upon contact with this wall 34, rotate rapidly to force the wall from its configuration as shown in FIG. 9 to that shown in FIG. 10. Particularly, FIGS. 9 and 10 depict a vertical line V—V. Vertical line V—V is coincident with the vertical axis of container 20. FIG. 9 shows a container 20 before reforming. In this FIG. 9, the wall is substantially vertical and may even have a so-called "positive" angle. With reference to FIG. 9, a positive angle is one in which wall 34 angles upwardly and to the right of line V—V. An example of a positive angle appears as angle C in FIG. 9.

After contact by rollers 36, as described above, this wall 34 is reformed to achieve a negative angle A. The results of reforming are shown, for example, in FIG. 10. As a result of this negative angle, as will be described below, container 20 has enhanced physical characteristics.

Figure 3:
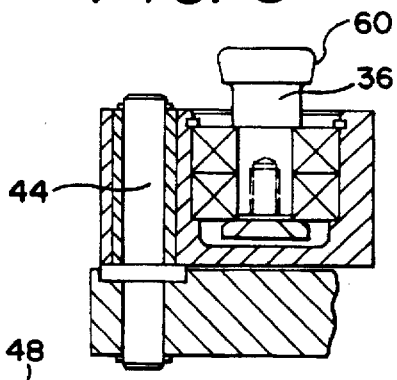
FIG. 3 is a detail of a portion of the apparatus of FIG. 2, showing the pivot pin about which the roller pivots.

In the apparatus of FIGS. 1–3, the pivot pin is substantially vertically disposed. As a result, the pivoting of the bearing housing 54 and the pivot plate 38 occur in a horizontal plane. Other embodiments, as described below, will include horizontal pivot pins, causing pivoting of the bearing housing and pivot plate in a vertical plane.

As may be seen in greatest detail in FIGS. 2 and 3, the reforming rollers 36 have a perimeter portion 60 that is downwardly tapered. It is this downwardly tapered configuration 60 which, when rollers 36 are placed against the substantially vertical wall 34, results in the reformation of that substantially vertical wall 34 to a wall having a negative angle.

Figure 1A:
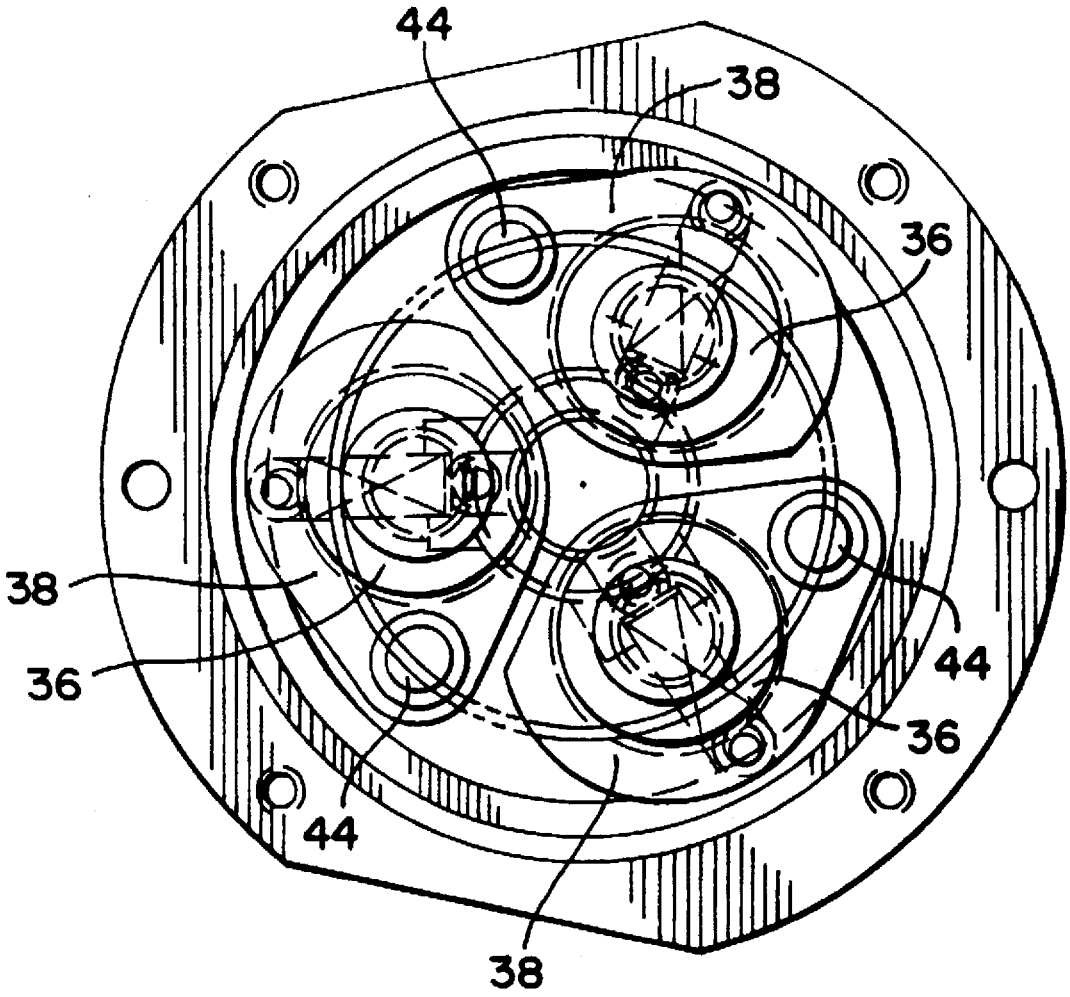
FIG. 1A is a view of the apparatus of FIG. 1, but with the rollers in a radially outward position and engaging the wall of a container.

After the completion of the reforming, the rollers 36 are retracted from the wall 34 and return from the position shown in FIG. 1A to the original position shown in FIG. 2. Each pivot plate 38 and bearing housing 54 assembly returns to this original position as a result of pressure from a compression spring 62.

Figure 4:
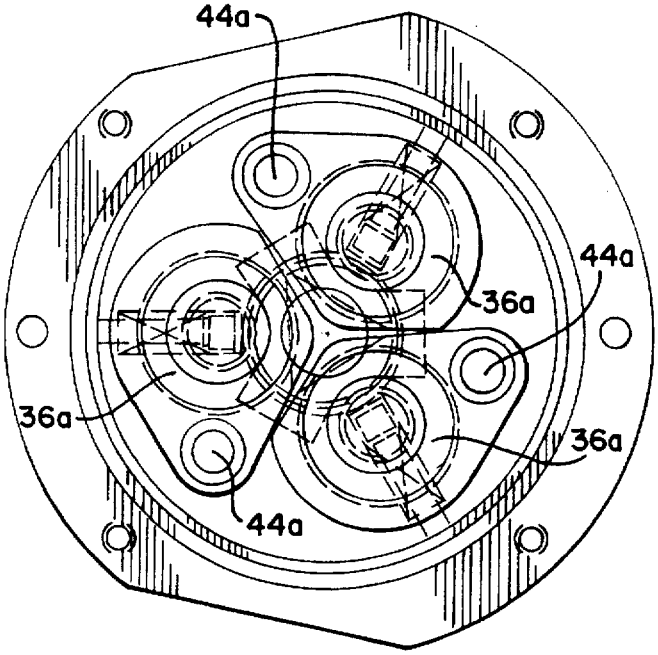
FIG. 4 is a top view of a second pivoting embodiment of the apparatus in accordance with the invention.
Figure 5:
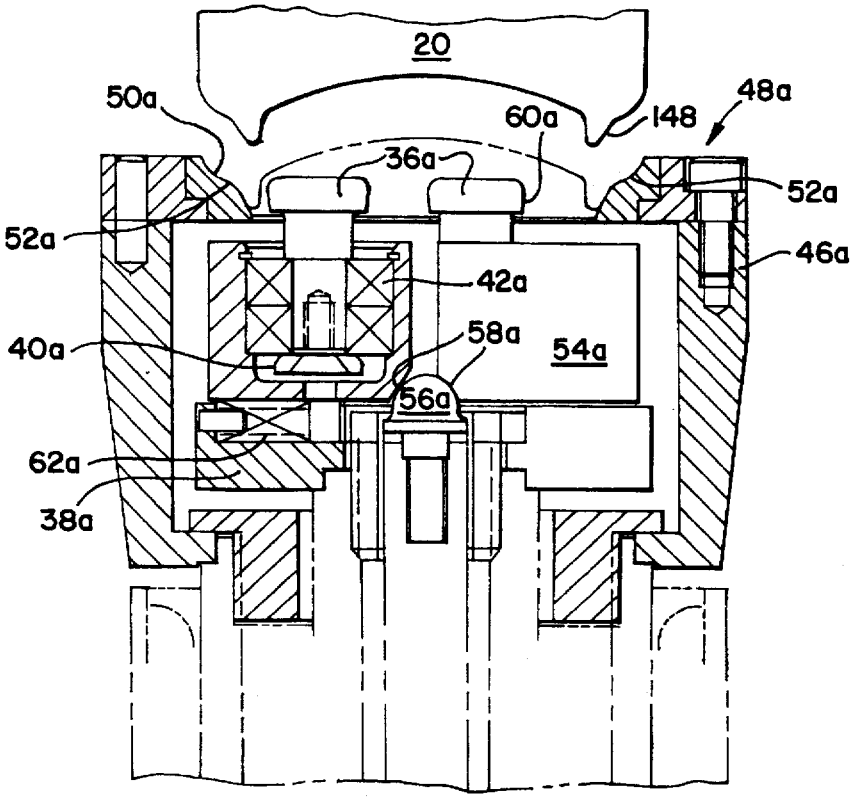
FIG. 5 is a side-sectional view of the apparatus of FIG. 4, and with a container shown in solid lines above the apparatus and in phantom lines in place for processing by the apparatus.

A slight modification of the reforming apparatus described above is shown in FIGS. 4 and 5. Each of the components of the embodiments of FIGS. 1–3 are correspondingly numbered in FIGS. 4 and 5, except that the reference numerals for the corresponding components in the latter figures include the suffix "a." The only component which differs significantly is the spring. Spring 62 of FIGS. 1–3 is an extension spring, whereas spring 62*a* of FIGS. 4–5 is a compression spring. As a result, the apparatus of FIGS. 4–5 works in a slightly different manner than the apparatus of FIGS. 1–3. Particularly, in FIGS. 1–3, upon completion of reforming, the rollers 36 are retracted from the wall 34 and returned to their original position as a result of both applied pressure from an extension spring 62 and retraction of the actuator ball 56. In FIGS. 4–5, upon completion of the reforming, the rollers 36*a* are retracted from the wall 34 and returned to their original position as a result of both applied pressure from a compression spring 62*a* and retraction of actuator ball 56*a*.

Figure 6:
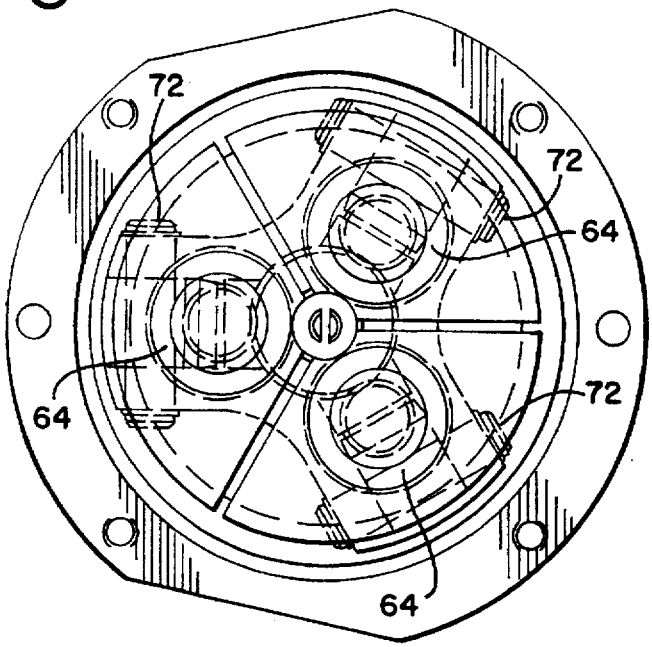
FIG. 6 is a top view of a third pivoting embodiment of the apparatus in accordance with the invention.
Figure 7:
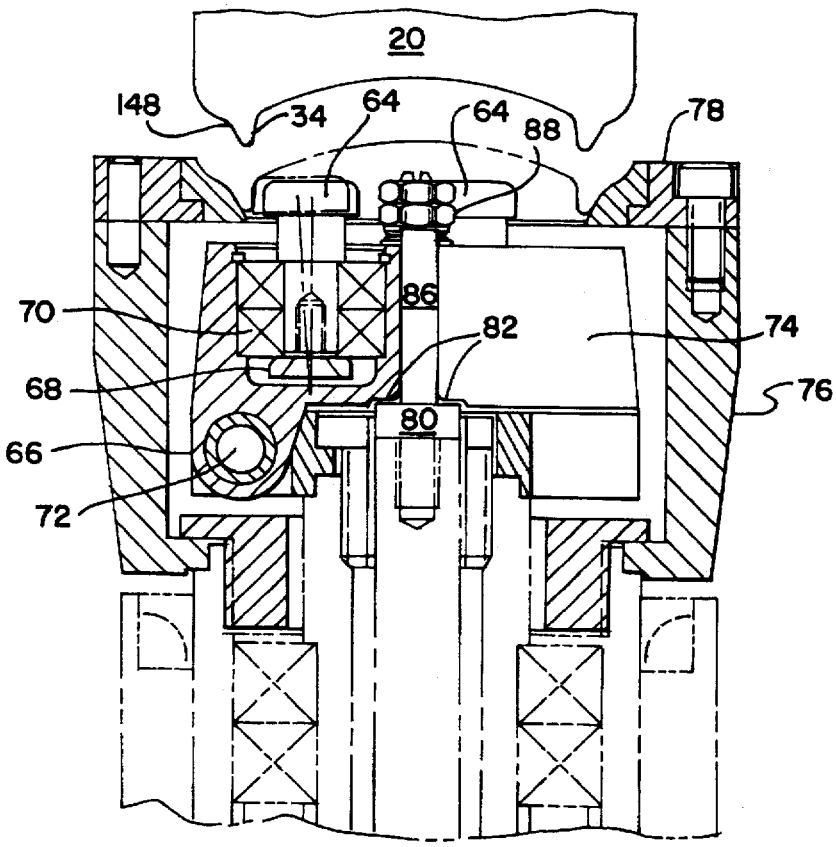
FIG. 7 is a side-sectional view of the apparatus of FIG. 6, and with a container shown in solid lines above the apparatus and in phantom lines in place for processing by the apparatus.

Still another embodiment is shown in FIGS. 6 and 7. This embodiment also includes three rollers 64. As may be seen in FIG. 7, each of these rollers 64 is indirectly secured to a pivot plate 66. Securing the rollers 64 are a bearing clamp 68 and at least one bearing 70.

Each of the pivot plates 66 are designed to pivot around their respective pivot pin 72. As may be seen in FIG. 7, this pivot pin 72 is horizontally disposed. As a result, the pivoting of the bearing housing 74 and the pivot plate 66 occur in a vertical plane.

As in the embodiment of FIGS. 1–3, the embodiment includes a tooling head collar 76 to provide a support surface for a jig 78, or lower can support. This jig 78 is also removable from the tooling head collar 76 and may be interchanged with another jig having a different shape to accommodate containers having various different lower end configurations.

Movement of the pivot plates 66 and bearing housings 74 is facilitated by a vertically movable actuator 80. As shown in FIG. 7, this actuator 80 is positioned in a first, non-engaging position. In this position, the actuator 80 merely abuts against camming surfaces 82 on the bearing housing 74.

Upward, vertical movement urges the actuator 80 to a second position in which it contacts and pushes upwardly on camming surfaces 82. As a result, this upward movement causes the bearing housing 74 and pivot plate 66 to pivot together about the pivot pin 72 in a vertical plane and a radially outward direction. This pivoting movement continues until rollers 64 contact the annular, substantially vertical wall 34 of container 20.

After the completion of the reforming, the rollers 64 are retracted from the wall 34 and return from the position shown in the dotted lines of FIG. 7 to the original position shown the solid lines of FIG. 7. Each pivot plate 66 and bearing housing 74 assembly returns to this original position as a result of pressure from a coil spring 84. This coil spring 84 encircles and is held upon a retaining post 86. The coil spring 84 is tensioned by compressing it between the top, abutting surfaces of bearing housings 74 and hex nut 88 secured to retaining post 86.

Still other embodiments of the present apparatus are depicted at FIGS. 11–19. As will be seen, the apparatus of these embodiments does not include a pivot pin for moving the rollers into engagement with the vertical wall 34 of the container 20. In many other respects, however, these apparatus are similar to those shown in FIGS. 1–7.

Figure 12:
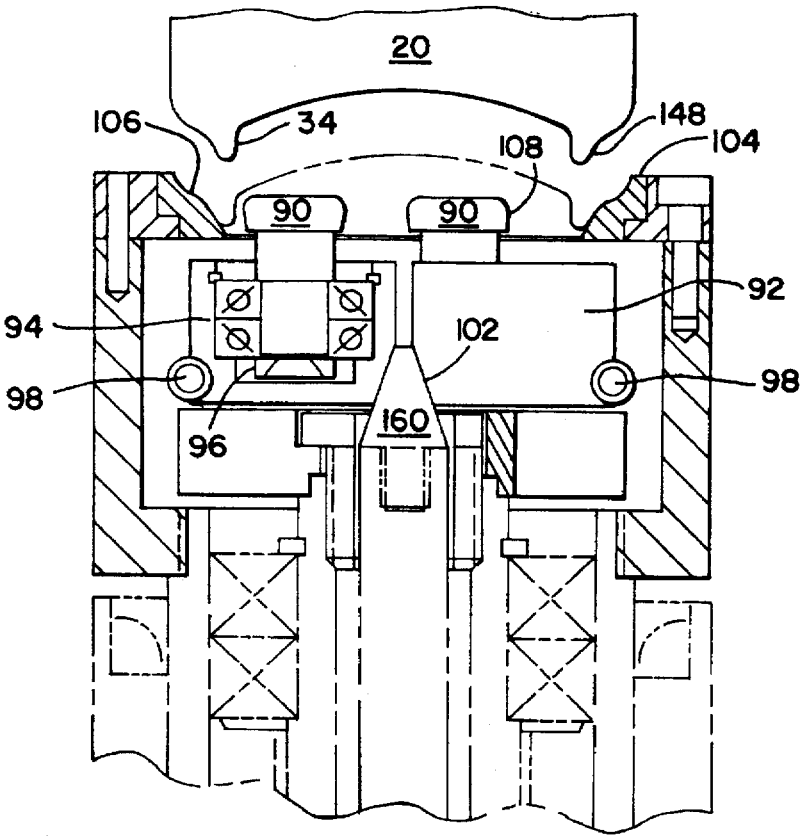
FIG. 12 is a side-sectional view of the apparatus of FIG. 11, and with a container shown in solid lines above the apparatus and in phantom lines in place for processing by the apparatus.

For example, the apparatus of FIG. 11 includes three rollers 90 secured to a bearing housing 92 with a bearing 94 and a bearing clamp 96. The solid lines of FIG. 12 show these rollers in a radially inward position, where the rollers 90 do not contact the annular, substantially vertical wall 34. These rollers 90 are movable from this position to a radially outward position where the roller contacts the annular, substantially vertical wall 34.

Bearing housings 92 are spring-biased. In particular, a tensioned garter spring 98 (FIG. 12) encircles the lower periphery of bearing housings 92. In their first, non-engaging position, as shown in the dotted lines of FIG. 11, the housings 92 and their related rollers 90 are retained by the garter spring 98 in a radially inward position.

The second position of the bearing housings 92 is shown in the solid lines of FIG. 11. The housings 92 attain this position when actuator 100 is moved upwardly against camming surfaces 102 of housing 92. This upward movement of actuator 100 pushes housings 92 radially outwardly until rollers 90 contact the annular, substantially vertical wall 34. Upon completion of treatment of the wall 34 with rollers 90, the actuator 100 is withdrawn and garter spring 98 urges the bearing housings 92 back into their first position.

As in the prior embodiments, the embodiment of FIGS. 11 and 12 includes a jig 104 to support the container along a bottom peripheral profile portion 106 that substantially corresponds in shape to the outer annular wall 26 of the container 20. As in the prior embodiments, the perimeter 108 of the rollers 90 also include a downwardly tapered configuration which, when placed against the substantially vertical wall 34, reforms that wall 34 to achieve a negative angle relative to the vertical axis of the container 20.

Figure 13:
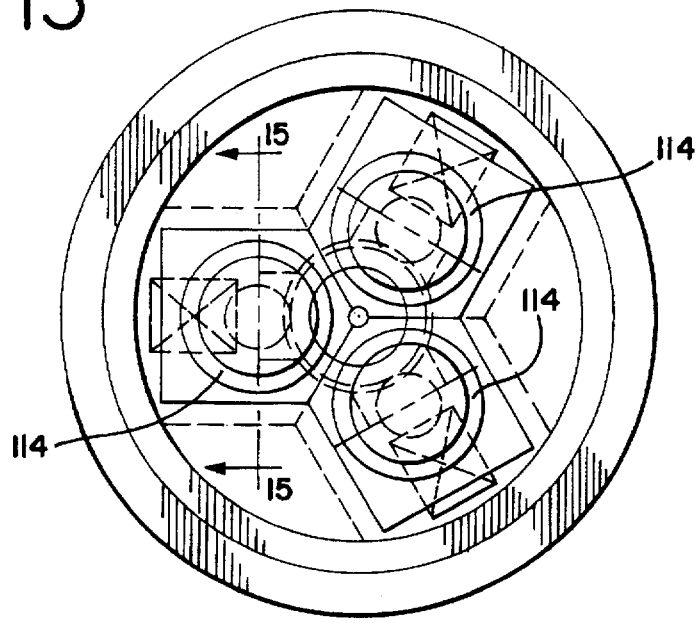
FIG. 13 is a top view of a second non-pivoting embodiment of the apparatus in accordance with the invention.
Figure 14:
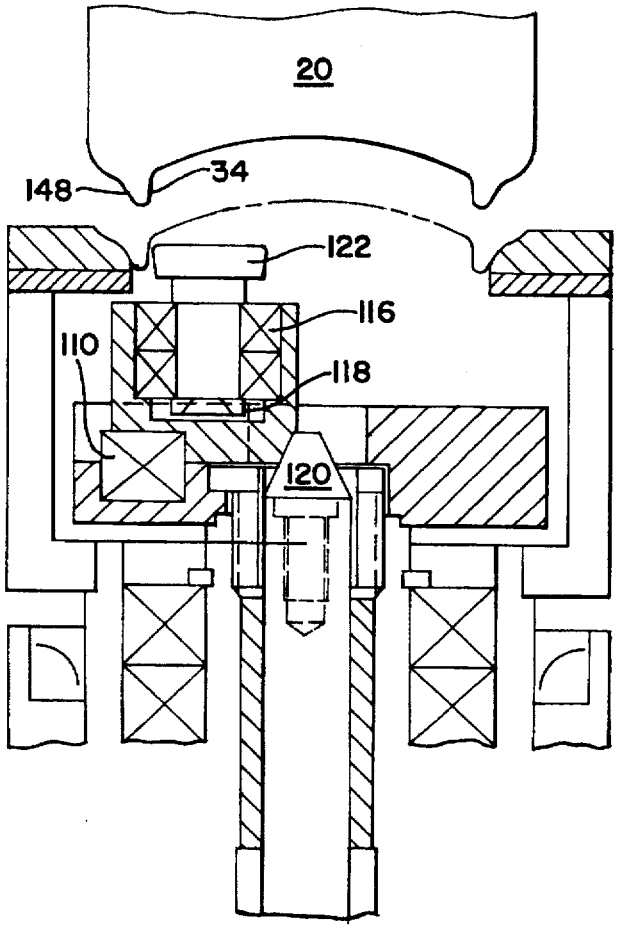
FIG. 14 is a side-sectional view of the apparatus of FIG. 13, and with a container shown in solid lines above the apparatus and in phantom lines in place for processing by the apparatus.
Figure 15:
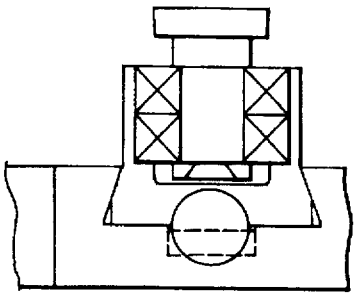
FIG. 15 is a detail of the roller and bearing of FIG. 14, taken along lines 15—15 of FIG. 13.

Another three-roller, non-pivoting embodiment of the apparatus of the invention is shown in FIGS. 13–15. In this embodiment, the spring 110 is horizontally disposed and acts along a horizontal plane. In particular, spring 110 is in contact with the bearing housing 112 to bias that housing 112 in a radially inward direction.

The apparatus of FIG. 13 also includes three rollers 114 secured to bearing housing 112 with a bearing 116 and a bearing clamp 118. These rollers 114 are movable from their first position, as shown in FIGS. 13–15, to a radially outward position where the rollers 114 contact the annular, substantially vertical wall 34 of container 20.

Upward movement of actuator 120 pushes housings 112 radially outwardly until rollers 122 contact the annular, substantially vertical wall 34. Upon completion of treatment of the wall 34 with rollers 122, the actuator 120 is withdrawn and spring 110 urges the bearing housings 112 back into their first position.

Figure 16:
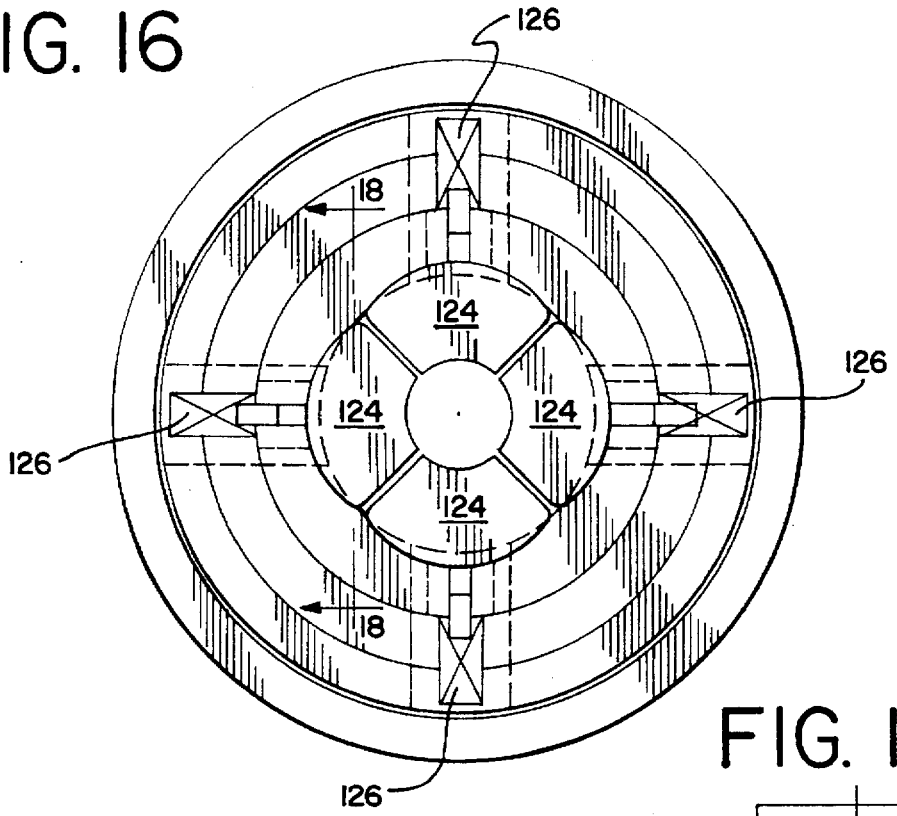
FIG. 16 is a top view of a third non-pivoting embodiment of the apparatus in accordance with the invention.
Figure 18:
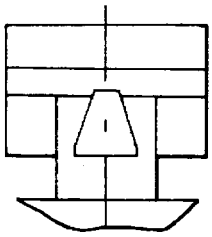
FIG. 18 is a detail of the actuator and dovetail slide portion of a portion of the apparatus of FIG. 16, taken along lines 18—18 of FIG. 16.
Figure 17:
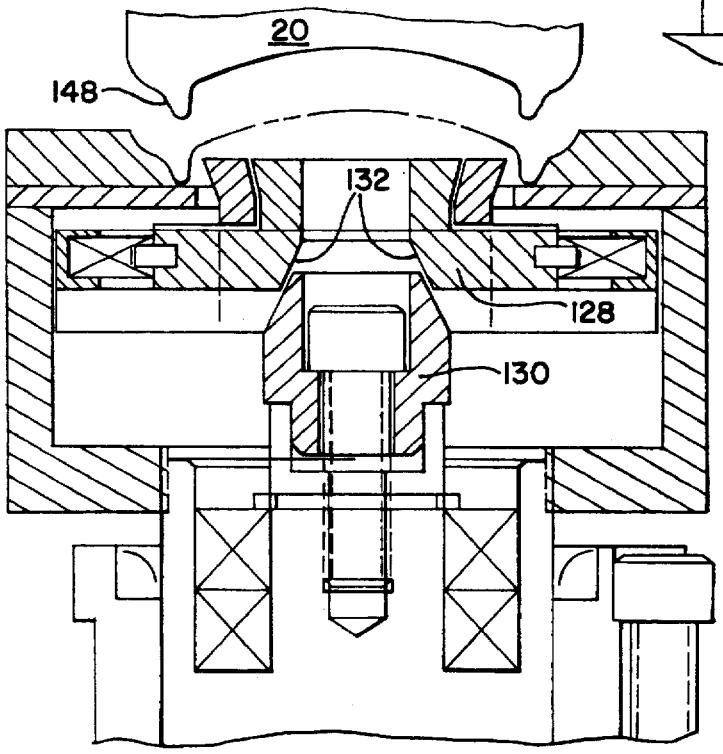
FIG. 17 is a side-sectional view of the apparatus of FIG. 16, and with a container shown in solid lines above the apparatus and in phantom lines in place for processing by the apparatus.

Still another non-pivoting embodiment of the apparatus of the invention is shown in FIGS. 16–18. In this embodiment, however, conventional rollers are not used. Rather, four roller segments 124 are mounted to the apparatus for radial movement towards and away from the container 20. In the dashed lines of FIG. 16, these segments 124 are shown in their normal, radially inward position. They are held in this position by a plurality of horizontally tensioned springs 126.

Each of these roller segments 124 may be secured to a housing 128. When an actuator 130 is moved vertically upwardly against camming surfaces 132, housings 128 are pushed radially outwardly, as shown in the solid lines of FIG. 16, until roller segments 124 contact the annular, substantially vertical wall 34. Upon completion of treatment of the wall 34 with roller segments 124, the actuator 130 is withdrawn and springs 126 urge the housings 128 back into their first position.

Figure 19:
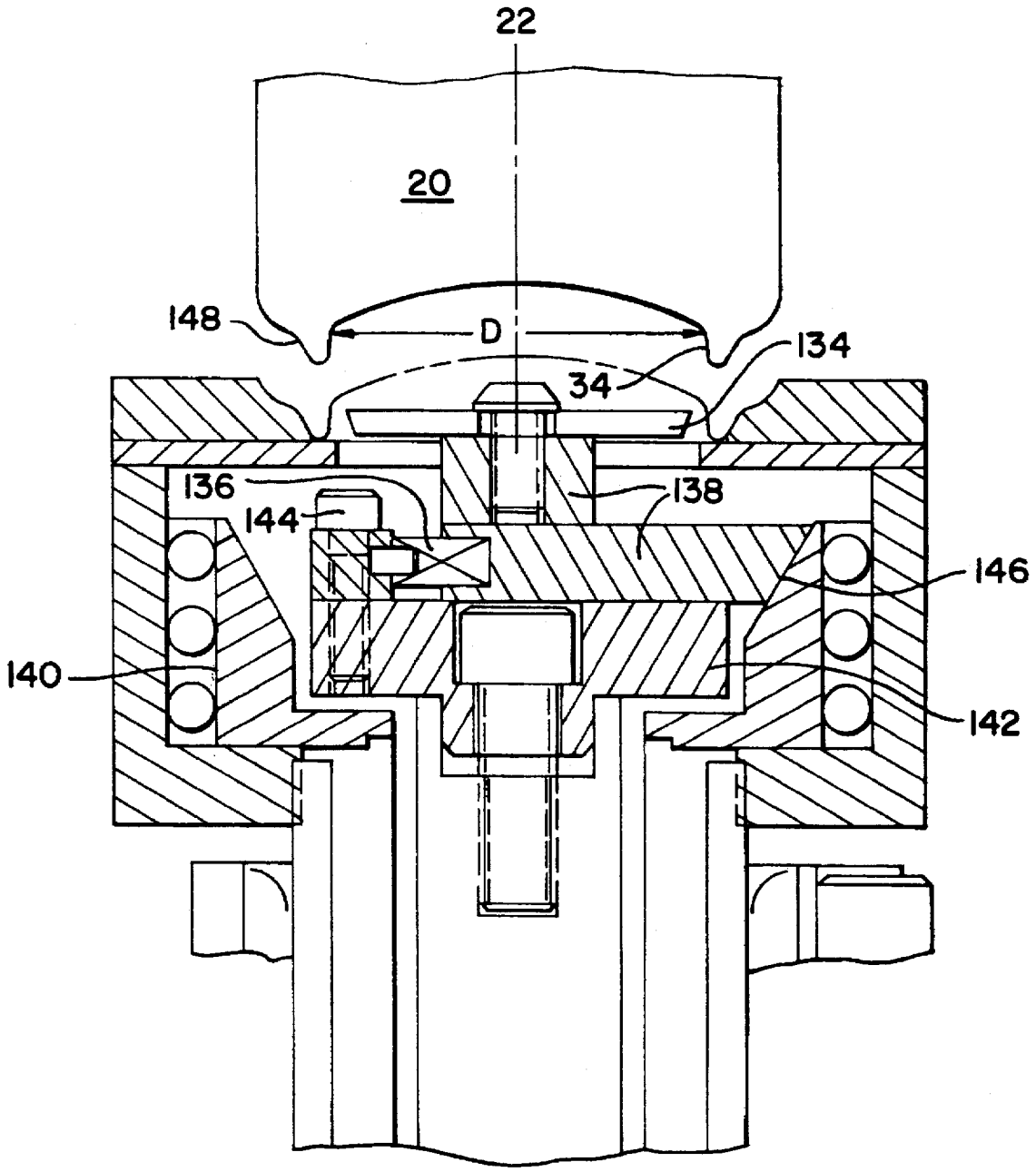
FIG. 19 is a side-sectional view of a fourth non-pivoting apparatus in accordance with the invention, including a single roller, and with a container shown in solid lines above the apparatus and in phantom lines in place for processing by the apparatus.

A final version of a non-pivoting embodiment of the apparatus is shown in FIG. 19. In this embodiment, only one roller is used. This roller 134 has a substantially larger diameter than the rollers of the other embodiments. In fact, the diameter of this roller 134 is in excess of 80 percent of the distance between opposite, facing walls 34. This distance is referred to as "D" in FIG. 19.

Again, this embodiment includes a compression spring 136 which acts along a horizontal plane. Spring 136 is in contact with the housing 138 to bias that housing 138 in a rightward direction. Roller 134 is movable from its first position, as shown in FIG. 19, to a radially outward position where the roller 134 contacts the annular, substantially vertical wall 34.

In the embodiment of FIG. 19, actuator 140 is vertically movable, as in the apparatus of the previously described embodiments. The actuator 140 encircles a dovetailed collar 142, and this collar 142 is fixed. Housing 138, however, is horizontally movable when it is contacted by the upwardly-moving actuator 140. The horizontal movement of the housing 138 is guided by a dovetail groove in collar 142.

Housing 138 abuts against camming surface 146. In addition, with reference to the directions depicted in FIG. 19, spring 136 biases the housing 183 to the right. Thus, housing 138 is moved to the right along the camming surface 146. This rightward movement of the housing 138 continues until the periphery of roller 134 contacts the wall 34 of container 20. Reforming takes place in the same manner as with a three-roller apparatus, but at only one point along the wall 34.

Upon completion of treatment of the wall 34 with roller 134, the actuator 140 is lowered and the weight of the housing/roller combination moves that assembly back onto the collar 142, i.e., to the first position of the device. This collar 142 acts as a limit on the downward movement of the housing 138. In this embodiment and in the others, it is preferred that the actuator 140 rotate at the same speed as housing 138.

A comparison of FIGS. 9 and 10 will disclose the differences in containers before and after bottom reforming in accordance with the method of the present invention. Particularly, FIG. 9 shows a container before bottom reforming. The wall 34 in this Figure is substantially vertical and may, in fact, have a slight positive angle. For the left portion of the container shown in FIG. 9, a wall 34 having a slight positive angle would angle upwardly and to the right from vertical line V—V. Referring to FIG. 8, and stated differently, when wall 34 has a positive angle, diameter D1 is greater than diameter D2.

As stated above, the container of FIG. 8 that may be reformed in accordance with this invention is generally symmetrical about a vertical axis 22. The container includes a generally cylindrical side wall 24 parallel with the vertical axis 22. The container 20 also includes an outer annular wall 26, a convex U-shaped portion 28, a preformed bottom wall 30, including a center domed portion 32 and an annular, substantially vertical wall 34 joining the domed portion 32 and the convex U-shaped portion 28.

The method of the present invention may be described with reference to the apparatus of FIGS. 1–3, and comprises several steps. The container 20 is supported on a jig 48. This jig 48 has a bottom peripheral profile portion 50 substantially corresponding in shape to the outer annular wall 26 of the container 20.

The bottom peripheral profile portion 50 of jig 48 is mated with the outer annular wall 26. Reforming rollers 36 are brought into engagement with the substantially vertical wall 34. The reforming rollers 36 rotate along the vertical wall 34 and about an arcuate path. Through this action, the reforming rollers 36 affect the angle of the substantially vertical wall 34. In particular, the angle of the substantially vertical wall 34 is changed to a negative angle from the vertical axis of the container 20.

As may be seen in FIG. 1A, the reforming rollers 36 of this apparatus are rotated about an arcuate path equidistant from an axis that is coaxial with the axis 22 of the container. Alternatively, as may be appreciated from a review of FIG. 19 and the above description of that figure, the reforming roller 134 of that apparatus may be rotated about an arcuate path that is equidistant from an axis that is not coaxial with the axis 22 of the container 20. This occurs because in order to contact wall 34, the roller 134 is shifted to the right of its position as shown in FIG. 19.

In one aspect of the preferred method, the roller has a peripheral configuration which, upon engagement with the substantially vertical wall, reforms the substantially vertical wall to achieve a negative angle from the vertical axis of the container. Rollers having such peripheral configurations are shown in FIGS. 2, 5, 7, 12, 14, 17 and 19.

In another aspect of the preferred method, an actuator is moved upwardly and towards the can to move a camming surface and its housing in a radially outward direction. In this way, a roller movable with the camming surface engages the substantially vertical wall.

In still another aspect of the preferred method, the roller pivots about a horizontal pivot point. In particular, the apparatus may include a horizontal pivot point about which the roller pivots from an inward non-engaging position to a radially outward position wherein the roller engages the substantially vertical wall.

After this method of bottom reforming, as may be seen in FIG. 10, the wall 34 exhibits a slight negative angle A. The preferred angle A for an ANC-2A can should be no more than approximately −4 degrees from the vertical line V—V. It is believed that enhanced container characteristics could be attained by providing wall 34 with an angle of as much as −8 to −10 degrees. For the left portion of the container shown in FIG. 10, a wall 34 having a slight negative angle would angle upwardly and to the left from vertical line V—V. Referring to FIG. 8, and stated differently, when wall 34 has a negative angle, diameter D1 would be less than diameter D2. The value of the preferred negative angle will vary with each different type of container.

Containers treated by the apparatus of the present invention exhibit distinctly superior characteristics when compared with prior art, untreated containers. Actual tests were conducted with so-called "ANC-2A" cans, manufactured by American National Can Company. These cans have the general configurations shown in FIGS. 8 and 9, and were made with aluminum having a gauge of 0.120. Prior to treatment of these cans by the method and apparatus of the invention, they exhibited the following characteristics:

TABLE 1

ANC-2A Dome Profile

| | Dome Depth | Dome Growth After 90 PSIG | Buckle Strength | Plate Thickness |
|---|---|---|---|---|
| Minimum | .394 | .052 | 98 | .0120 |
| Maximum | .396 | .060 | 99 | .0120 |

TABLE 1-continued

| ANC-2A Dome Profile | Dome Depth | Dome Growth After 90 PSIG | Buckle Strength | Plate Thickness |
|---|---|---|---|---|
| Average | .396 | .054 | 98 | .0120 |
| Spec/Aim | .394 ± .004 | .064 Max. | 90 Min. | Ref. |

After treatment of these cans by the method and one roller apparatus of the invention, they exhibited the following characteristics:

TABLE 2

| ANC Reformed Dome Profile | Dome Depth | Dome Growth After 90 PSIG | Buckle Strength | Plate Thickness |
|---|---|---|---|---|
| Minimum | .398 | .005 | 100 | .0120 |
| Maximum | .401 | .006 | 113 | .0120 |
| Average | .400 | .006 | 112 | .0120 |
| Spec/Aim | N/A | .064 Max. | 90 Min. | Ref. |

As can be seen from a comparison of these Tables, Buckle Strength of treated cans increased from an average of about 99 to an average of 112. The growth in the dome, which results in a downward extension of the U-shaped portion 28 of the container of FIG. 9, decreased markedly from an average of 0.055 to 0.006 inches.

When these same tests were conducted with cans produced from 0.110 gauge aluminum, Buckle Strength increased from an average of 90 to an average of 98. Dome growth tests after 90 PSIG were not meaningful, as the non-reformed cans failed and buckled at 90 PSIG or less.

Figure 20:
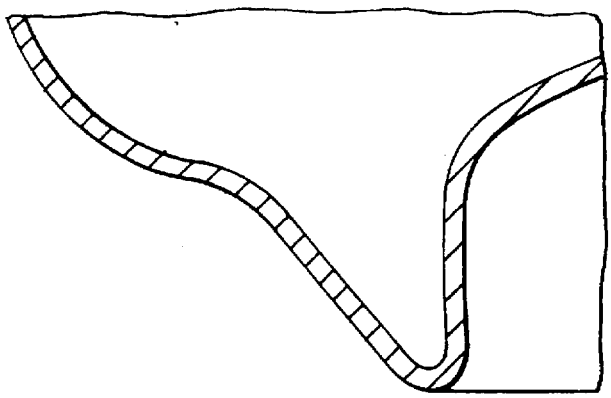
FIG. 20 is a photographic profile of a cross-section of a lower portion of a can reformed by a prior art process.

A number of standard ANC-2A cans were reformed. In the first set, the outside of the countersink was reformed in accordance with a CMB method, and its results are shown in Table 3. A photographic profile of a lower portion of one of these cans is shown in FIG. 20.

TABLE 3

Body Strength
206/211 × 413 CMB Reformed Dome Cans

| | Dome Depth | Dome Growth After 90 PSIG | Buckle Strength | Plate Thickness |
|---|---|---|---|---|
| Minimum | .385 | .008 | 104 | .0120 |
| Maximum | .395 | .012 | 109 | .0120 |
| Average | .392 | .010 | 106 | .0120 |
| Spec/Aim | N/A | .064 Max. | 90 Min. | Ref. |

| | Vertical Crush | Sidewall Thickness |
|---|---|---|
| Minimum | 226 | .0045 |
| Maximum | 292 | .0046 |
| Average | 279* | .0046 |
| Spec/Aim | 250 Min | |

Figure 21:
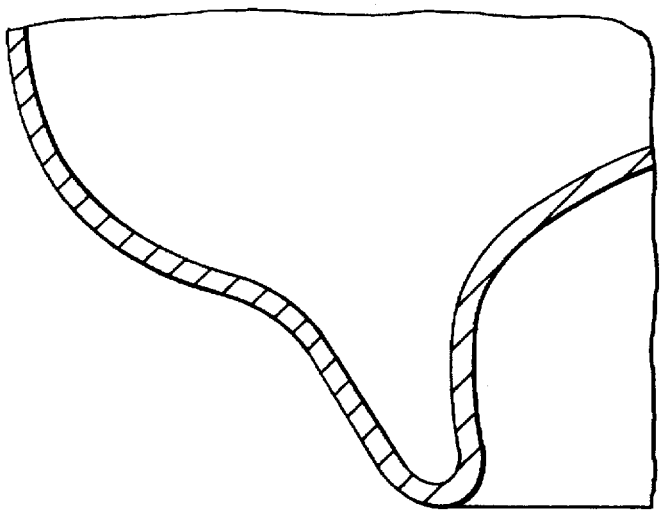
FIG. 21 is a photographic profile of a cross-section of a lower portion of a can reformed by the process of the present invention.

The second set of cans was reformed on the inside of the countersink in accordance with the present invention, and its results are shown in Table 4. A photographic profile of a lower portion of one of these cans is shown in FIG. 21.

TABLE 4

Body Strength
206/211 × 413 ANC Reformed Dome Cans

| | Dome Depth | Dome Growth After 90 PSIG | Buckle Strength | Plate Thickness |
|---|---|---|---|---|
| Minimum | .397 | .003 | 104 | .0120 |
| Maximum | .410 | .007 | 114 | .0120 |
| Average | .404 | .004 | 110 | .0120 |
| Spec/Aim | N/A | .064 Max. | 90 Min. | Ref. |

| | Vertical Crush | Sidewall Thickness |
|---|---|---|
| Minimum | 305 | .0045 |
| Maximum | 321 | .0047 |
| Average | 313* | .0046 |
| Spec/Aim | 250 Min | |

Figure 22:
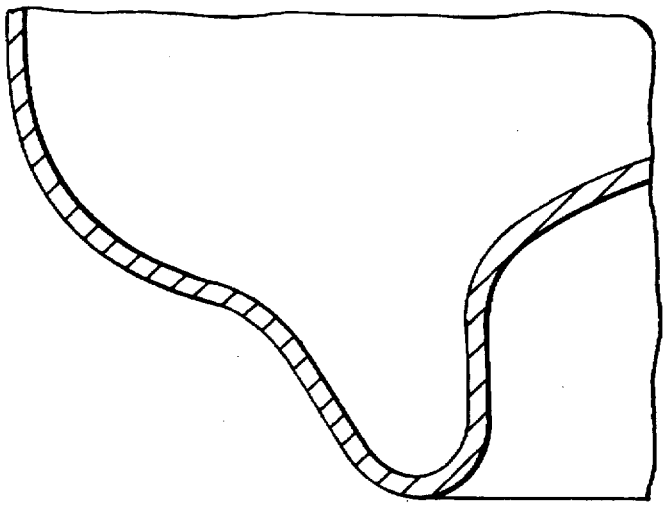
FIG. 22 is a photographic profile of a cross-section of a lower portion of a "control" can prior to reforming.

Table 5 shows results from "control" cans, i.e., standard ANC-2A cans prior to reforming of any kind. A photographic profile of a lower portion of one of these cans is shown in FIG. 22.

TABLE 5

Body Strength
206/211 × 413 ANC-2A Control Cans

| | Dome Depth | Dome Growth After 90 PSIG | Buckle Strength | Plate Thickness |
|---|---|---|---|---|
| Minimum | .396 | .042 | 98 | .0120 |
| Maximum | .398 | .059 | 99 | .0120 |
| Average | .397 | .048 | 99 | .0120 |
| Spec/Aim | .394 ± .004 | .064 Max. | 90 Min. | Ref. |

| | Vertical Crush | Sidewall Thickness |
|---|---|---|
| Minimum | 310 | .0045 |
| Maximum | 322 | .0046 |
| Average | 317* | .0046 |
| Spec/Aim | 250 Min | |

As may be seen by a comparison of these Tables, dome growth in the untreated can of Table 5 averages 0.050 inches. Both reformed cans show improvement, but the average dome growth of the can reformed in accordance with the present invention is significantly superior (0.005 vs. 0.010 inches). Buckle strength is also somewhat improved (109 vs. 106). Finally, while average vertical crush of the present reformed cans (313) remains virtually the same as the control can (317), average vertical crush drops significantly (279) after reforming by the CMB method.

As may be seen by a comparison of FIGS. 20 and 21, the can that has been reformed in accordance with the present invention is less sharply peaked along its bottom. As a result, this can will exhibit more stability when moving along fill lines.

While the specific embodiments have been demonstrated and described, numerous modifications come to mind without markedly departing from the spirit of the invention. The scope of protection is, thus, only intended to be limited by the scope of the accompanying claims.

We claim:

1. An apparatus for reforming a bottom of a drawn and ironed beverage container, said container having a longitudinal axis; a side wall parallel with said longitudinal axis; the bottom having an outer annular wall, a convex U-shaped portion, a preformed bottom wall, including a center domed portion; and an annular, substantially longitudinal wall joining said domed portion and said convex U-shaped portion; said apparatus comprising:

a roller movable from an inward position where said roller does not contact said annular, substantially longitudinal wall to an outward position where said roller contacts said annular, substantially longitudinal wall; and a movable actuator to move said roller into engagement with and circumferentially about said annular, substantially longitudinal wall to reform said substantially longitudinal wall.

2. The apparatus of claim 1 wherein said movable actuator moves said roller into engagement with said annular, substantially longitudinal wall to reform said substantially longitudinal wall to achieve a negative angle (A) relative to said longitudinal axis of said container.

3. The apparatus of claim 1, wherein said apparatus includes a plurality of rollers, each of said rollers movable from a radially inward position where said rollers do not contact said annular, substantially longitudinal wall to a radially outward position where said rollers contact said annular, substantially longitudinal wall.

4. The apparatus of claim 1 including a container support for inwardly supporting said container.

5. The apparatus of claim 4 wherein said container support supports said container along a lower end of said container.

6. The apparatus of claim 4 wherein said container support comprises a jig, said jig supporting said container along a lower end of said container.

7. The apparatus of claim 4, wherein said container support comprises a jig, said jig supporting said container along a bottom peripheral profile portion substantially corresponding in shape to said outer annular wall of said container, said bottom peripheral profile portion of said jig being mated with said outer annular wall of said container.

8. The apparatus of claim 4 wherein said movable actuator moves said roller into engagement with said annular, substantially longitudinal wall in opposition to said container support.

9. The apparatus of claim 1, wherein the perimeter of said roller has a downwardly tapered portion which, when placed against said substantially longitudinal wall, reforms said substantially longitudinal wall to achieve a negative angle (A) relative to the longitudinal axis of said container.

10. The apparatus of claim 1 wherein said apparatus includes three rollers.

11. A method of reforming a bottom of a drawn and ironed beverage container, said container having a longitudinal axis; a generally cylindrical side wall parallel with said longitudinal axis; the bottom having an outer annular wall, a convex U-shaped portion, a preformed bottom wall including a center domed portion, and an annular, substantially longitudinal wall joining said domed portion and said convex U-shaped portion, said method comprising:

providing said drawn and ironed beverage container;

providing a reforming roller; and moving said reforming roller radially into engagement with said substantially longitudinal wall of said beverage container, said reforming roller rotating along said longitudinal wall and circumferentially about an arcuate path, wherein said reforming roller affects the angle of said substantially longitudinal wall.

12. The method of claim 11 including the step of providing radial inward support for said container.

13. The method of claim 12, wherein said reforming roller is rotated about an arcuate path equidistant from an axis that is coaxial with the longitudinal axis of the container.

14. The method of claim 12 wherein said providing radial inward support includes supporting said container along a lower end of said container.

15. The method of claim 12 wherein said providing radial inward support includes supporting said container in a jig, said jig supporting said container along a lower end of said container.

16. The method of claim 12 wherein said providing radial inward support includes supporting said container in a jig, said jig supporting a bottom peripheral profile portion substantially corresponding in shape to said outer annular wall of said container, and mating the bottom peripheral profile portion of said jig with said outer annular wall.

17. The method of claim 11, wherein said reforming roller affects the angle of said substantially longitudinal wall by achieving a negative angle (A) from the longitudinal axis of said container.

18. The method of claim 11, wherein said roller has a tapered peripheral portion which, upon engagement with said substantially longitudinal wall, reforms said substantially longitudinal wall to achieve a negative angle from the longitudinal axis of said container.

19. An apparatus for reforming a bottom of a drawn and ironed beverage container, said container having a longitudinal axis; a side wall parallel with said longitudinal axis; the bottom having an outer annular wall, a convex U-shaped portion, a preformed bottom wall, including a center domed portion; and an annular, substantially longitudinal wall joining said domed portion and said convex U-shaped portion; said apparatus comprising:

means for radially inwardly supporting a lower end of said container;

a roller movable from a radially inward position where said roller does not contact said annular, substantially longitudinal wall to a radially outward position where said roller contacts said annular, substantially longitudinal wall; and a movable actuator to move said roller in opposition to said radial inward supporting means and into engagement with and circumferentially about said annular, substantially longitudinal wall to reform said substantially longitudinal wall.

20. The apparatus of claim 19 wherein said movable actuator moves said roller into engagement with said annular, substantially longitudinal wall to reform said substantially longitudinal wall to achieve a negative angle (A) relative to said longitudinal axis of said container.

21. A method for reforming a bottom of a drawn and ironed beverage container, said container having a longitudinal axis; a side wall parallel with said longitudinal axis; the bottom having an outer annular wall, a convex U-shaped portion, a preformed bottom wall, including a center domed portion; and an annular, substantially longitudinal wall joining said domed portion and said convex U-shaped portion; said method comprising:

providing said drawn and ironed beverage container;

radially inwardly supporting a lower end of said container;

providing a roller;

moving said roller from a radially inward position where said roller does not contact said annular, substantially longitudinal wall to a radially outward position where said roller contacts said annular, substantially longitudinal wall; and circumferentially moving said roller in opposition to said radial inward supporting means and in engagement with said annular, substantially longitudinal wall to reform said substantially longitudinal wall.

22. The method of claim 21 wherein said movable actuator moves said roller into engagement with said annular, substantially longitudinal wall to reform said substantially longitudinal wall to achieve a negative angle (A) relative to said longitudinal axis of said container.

* * * * *